United States Patent [19]

Van Handel et al.

[11] Patent Number: 4,721,500

[45] Date of Patent: Jan. 26, 1988

[54] METHOD OF FORMING A RIGID PAPER-BOARD CONTAINER

[75] Inventors: Gerald J. Van Handel, Neenah; John L. Petit, Appleton; Patrick H. Wnek, Sherwood, all of Wis.

[73] Assignee: James River-Dixie Northern, Inc., Norwalk, Conn.

[21] Appl. No.: 870,038

[22] Filed: Jun. 3, 1986

Related U.S. Application Data

[62] Division of Ser. No. 764,965, Aug. 12, 1985, Pat. No. 4,609,140.

[51] Int. Cl.[4] ..... B31B 1/28

[52] U.S. Cl. ..... 493/152; 493/154; 493/167; 493/339; 264/324

[58] Field of Search ..... 493/152, 154, 158, 168, 493/185, 141, 151, 464, 902, 338, 85, 339; 162/223, 224, 231, 377, 416; 264/293, 322, 324; 425/398

[56] References Cited

U.S. PATENT DOCUMENTS

| | | | |
|---|---|---|---|
| 448,748 | 3/1891 | Comings | 493/152 |
| 2,832,522 | 4/1958 | Schlanger | 493/152 |
| 3,305,434 | 2/1967 | Bernier et al. | 162/223 |
| 3,684,633 | 8/1972 | Haase | 428/66 |

*Primary Examiner*—Robert P. Olszewski
*Assistant Examiner*—Robert Showalter
*Attorney, Agent, or Firm*—Finnegan, Henderson, Farabow, Garrett & Dunner

[57] ABSTRACT

A pressed paperboard container (10) is formed having a bottom wall (11), an upturned side wall (12), and an overturned rim (13) extending from the side wall which is denser and thinner than the rest of the container. The container is formed by pressing a flat circular blank (27) between upper and lower dies (25, 26) having die surfaces (31, 32, 38, 39, 40) which shape the blank into proper form, and the surfaces of the dies (25, 26) at the rim area (13) of the container are shaped to exert extremely high compressive stresses on the rim, particularly at the folded areas (20) formed in the rim during initial shaping of the container. The high compressive stresses applied to the rim area, along with proper moisture levels maintained in the paperboard and the heating of the paperboard by the heated dies, causes the paperboard in the rim area to deform plastically, densify, and fill in voids created as the blank was pressed into the container form. The integral, dense rim is a rigid structure which provides resistance to bending to the entire container.

13 Claims, 10 Drawing Figures

METHOD OF FORMING A RIGID PAPER-BOARD CONTAINER

This is a division of application Ser. No. 764,965, filed Aug. 12, 1985 now U.S. Pat. No. 4,609,140.

TECHNICAL FIELD

This invention pertains generally to the field of processes and apparatus for forming pressed paperboard products such as paper trays and plates and to the products formed by such processes.

BACKGROUND ART

Formed fiberboard containers, such as paper plates and trays, are commonly produced either by molding fibers from a pulp slurry into the desired form of the container or by pressing a paperboard blank between forming dies into the desired shape. The molded pulp articles, after drying, are fairly strong and rigid but generally have rough surface characteristics and are not usually coated so that they are susceptible to penetration by water, oil and other liquids. Pressed paperboard containers, on the other hand, can be decorated and coated with a liquid-proof coating before being stamped by the forming dies into the desired shape. Large numbers of paper plates and similar products are produced by each of these methods every year at relatively low unit cost. These products come in many different shapes, rectangular or polygonal as well as round, and in multicompartment configurations.

Pressed paperboard containers tend to have somewhat less strength and rigidity than do comparable containers made by the pulp molding processes. Much of the strength and resistance to bending of a plate-like container made by either process lies in the side wall and rim areas which surround the center or bottom portion of the container. In plate-like structures made by the pulp molding process, the side wall and overturned rim of the plate are unitary, cohesive structures which have good resistance to bending as long as they are not damaged or split. In contrast, when a container is made by pressing a paperboard blank, the flat blank must be distorted and changed in area in order to form the blank into the desired three dimensional shape. Score lines are sometimes placed around the periphery of blanks being formed into deep pressed products to allow the paperboard to fold or yield at the score lines to accommodate the reduction in area that takes place during pressing. However, the provision of score lines, flutes, or corrugations in the blank may result in a formed product with natural fault lines about which the product will bend more readily, under less force, than if the product were unflawed. Shallow containers, such as paper plates, may also be formed from paperboard blanks which are not scored or fluted, but the pressing operation will cause wrinkles or folds to form in the paperboard material at the rim and side walls of the container at more or less random positions; these folds, again, act as natural lines of weakness within the container about which bending can occur.

In the common process for pressing paperboard containers from flat blanks, a sheet or web of paperboard is cut to form the blank—a circular shape for a plate—and the blank is then pressed firmly between upper and lower dies which have die surfaces conforming to the desired shape of the finished container. The paperboard web stock is usually coated with a liquid-proof material on one surface and may also have decorative designs printed under the coating. The surfaces of the upper and lower dies have typically been machined such that, when they begin to compress the shaped paperboard blank between them, the die surfaces will be generally spaced uniformly apart over the entire surface area of the formed paperboard. The lower die is spring mounted to limit the maximum force applied to the paperboard between the dies; and this force is distributed over the entire area of the paperboard if the spacing between the dies is uniform. In practice, the machining of the dies is such that random high and low spots are commonly formed on the die surfaces, resulting in random, localized areas of the paperboard which are highly pressed while other areas are unpressed. The dies are also generally heated to aid in the forming and pressing operation. Paperboard plates produced in this manner have good decoration quality and liquid resistance because of the surface coating, and are suited to high production volume with resulting relatively low unit cost. However, as noted above, the plates suffer from a lower than desired level of rigidity and are subject to greater bending during normal household use than is perhaps most desirable.

While problems with the rigidity of pressed paperboard containers have long been known, there has heretofore been limited success in improving the rigidity qualities of these products in a commercially practical manner. One example of a process intended to increase the rigidity of pressed paper plates is shown in the patent to *Bernier, et al.*, 3,305,434. A process is disclosed therein in which paperboard having very high moisture content, in the range of 15% to 35% by weight, is pressed between heated forming dies which are specially designed to allow escape of the water vapors driven off during the pressing operation. The paperboard blank stock is thus relatively soft and easily formed into shape. Distortion of the shape of the soft and flowable fiberboard is prevented by driving the forming dies to a stop at which the surfaces of the dies are uniformly spaced apart a distance approximately equal to or slightly less than the desired thickness of the formed container. The shaped fiberboard material dries under the heat and pressure applied by the dies and the fibers within the material build up internal bonds upon drying which help to maintain the strength and rigidity of the deformed portions of the paperboard material. The apparent limitations of such a process are the complex dies required to allow release of the water vapors from the pressed fiberboard, handling problems with high moisture fiberboard, and slower production times required because of the time necessary to allow removal of the water vapor from the paperboard during the pressing operation, thereby all contributing to increased production costs.

DISCLOSURE OF THE INVENTION

The paperboard container of the present invention is formed from fibrous substrate stock in such a way that the raised areas of the container are substantially free of the type of fault lines which are found in paper-board containers pressed in a conventional manner. Exemplary of products formed in accordance with the invention is a container having a bottom wall, an upturned side wall extending from the bottom wall, and a rim extending from the side wall. The bottom wall of the formed container is substantially equal in thickness and density to the blank, whereas the rim is preferably somewhat denser generaly than the blank and is substantially denser in those areas where folds are formed in the rim during initial shaping. Those portions of the paperboard which are folded up during forming are substantially the same thickness as the rest of the container, although containing more fibrous material, and the entire surface of the rim area is essentially smooth. The upturned side wall, or a portion thereof, may also be densified, particularly in the areas of the folds formed therein. The container may be formed in the various geometric shapes used for pressed paperboard products. The rim preferably has a downturned edge portion, compressed and densified, which is found to particularly enhance the rigidity of the container structure. The paperboard stock may be coated in a conventional manner to provide decoration and liquid-proofing. Because of the lack of voids and other fault lines, the container of the invention will have a rigidity at least 40% and often 100% greater than conventional containers pressed from the same paperboard stock.

In the method for forming a paper board blank into the container described above, the blank material is selected to have a moisture content before forming in the range of 8% to 12% by weight, and preferably 9.5% to 10.5% by weight. The blank is then pressed between a pair of mating dies having die surfaces generally conforming to the shape of the formed plate, but with the adjacent surfaces of the dies at the rim area being closer together than at the bottom wall area as the die surfaces approach. During the forming operation, the surfaces of the two dies engage the paperboard blank between them and distort the blank into the general shape of the formed product. However, as the die surfaces continue to approach, the more closely spaced die surfaces at the rim engage the paperboard in the area of the rim between them before the paperboard in the bottom wall portion of the blank is firmly engaged; as a result, extremely high compression forces are applied in the rim area and, in particular, at any downwardly extending portions of the rim. Compression force may also be applied to the upturned side wall to press out wrinkles and voids created therein during initial shaping of the container. The moisture in the paperboard helps to weaken the fiber bonds within the paperboard, thereby allowing the fibers to disengage from one another and flow under the intense compression force applied to the rim area, particularly at the folds. The flowing of the fibers within the fiberboard under pressure causes the wrinkles and other fault lines within the rim to be substantially eliminated so that, after the dies are removed from the paperboard and the bonds between fibers are reformed, the rim area of the formed container is a substantially integral structure.

Under preferred conditions, the dies are maintained at a temperature between 250° F. and 320° F. These temperatures are found to yield the best conditions of fiber flow and distortion under the intense pressures applied by the dies without overheating the blank and causing surface blisters or scorching of the paperboard. As moisture is driven out of the heated paperboard, bonds between fibers are reformed in their compressed positions. The dies are mounted in a conventional manner, such that the motion of the die surfaces toward one another is stopped only by the compression of the paperboard material between them. The force applied to the dies is limited by the spring mounting of the lower die, typically at a force of at least 6,000 pounds and preferably 8,000 pounds or more for containers in the common 9 to 10 inch diameter range. Most of the force between the dies is applied to the rim area of the formed plate, yielding typical pressures in the rim area of at least 200 pounds per square inch and even greater localized pressures at the areas where the paperboard is initially folded.

Further objects, features and advantages will be apparent from the following detailed description taken in conjunction with the accompanying drawings.

BEST MODE FOR CARRYING OUT THE INVENTION

Figure 1:
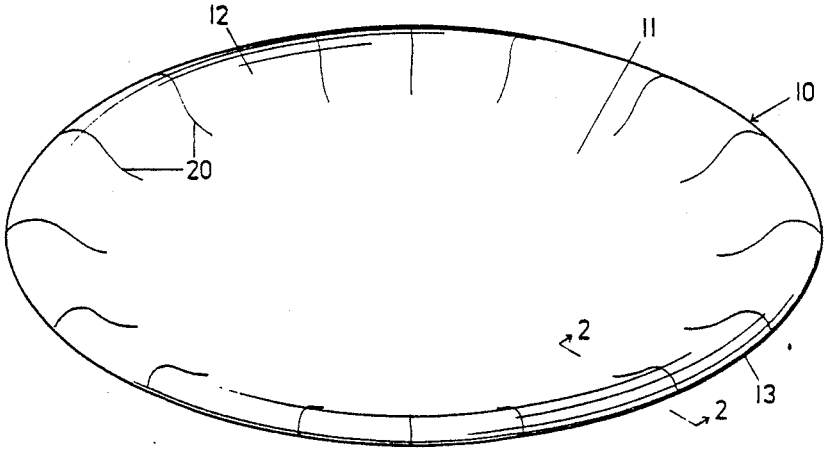
FIG. 1 is a perspective view of a plate-like paperboard container in accordance with the invention.

With reference to the drawings, a paperboard container in the form of a plate is shown in perspective at 10 in FIG. 1. This container structure will be described to illustrate the invention, although it will be readily apparent that the invention can be incorporated in many other container geometries. The form of the plate 10 is typical of commercially produced plates now distributed in the mass market: it has a substantially flat, circular bottom wall portion 11, an upturned side wall portion 12 which serves to contain food and particularly juices on the plate, and an overturned rim portion 13 extending from the side wall. The plate portions 11, 12, and 13 are formed integrally with one another. The distinctions between the portions may be best illustrated with respect to the cross-sectional view of FIG. 2. The flat bottom wall 11 of the plate extends to about the position in the plate denoted at 15, at which the side wall 12 begins rising upwardly; the upturned side wall 12 terminates at about the position marked 16 in FIG. 2, at which the paperboard begins to curve over and down about a smaller radius to form the overturned rim 13 which terminates at a peripheral rim edge 17.

The rim 13 serves a number of purposes in the paper plate product. It provides a more aesthetically pleasing appearance than would a plate which simply had an upturned side wall terminating in an edge, and it provides a generally lateral area which can be gripped by a user when carrying the plate. From the standpoint of the structural integrity of the plate, the most important function of the rim 13 is to make the plate rigid and resistant to bending when held by a user. As is apparent from an examination of the cross-sectional view of FIG. 2, the vaulted shape of the overturned rim 13 provides a structure which is naturally resistant to bending about any radial axis extending from the center of the plate. If the paperboard forming the rim portion 13 is unitary and cohesive, the plate will resist bending in the hand of a user until the plate is loaded so heavily that the paperboard in the rim 13 is under tensile stress sufficient to cause the paperboard to yield and buckle. The maximum tensile stress in the plate under normal loading will lie across a generally radial cross-section through the rim area.

While the theoretical maximum load carrying capabilities of a paper plate are related to the tensile strength of the paperboard of which the plate is made, plates made by the conventional blank pressing process are found to have much lower load carrying capabilities than might be expected, due to folds and wrinkles formed in the rim. These folds and wrinkles naturally occur in the incipient rim during forming to accommodate the decrease in area of the rim as it is being drawn radially inwardly during formation of the upwardly turned wall 12. The wrinkles or folds extend radially over the rim and usually extend through a portion of the upwardly turned side wall 12, which is also somewhat shrunk in surface area. The wrinkling or folding of the rim material produces a disruption of the fiberboard material at the fold, breaking many bonds between fibers, and results in a radial fault line in the rim—a natural hinge—which is much less resistant to stresses produced by loads on the plate than the original paperboard. Since such wrinkling is inevitable in normal pressing processes, it has heretofore not been considered feasible to significantly increase the rigidity of plates pressed from flat paperboard blanks. Paperboard blanks, especially those to be deep pressed, are commonly provided with a plurality of radial score lines to control the number and position of the wrinkles in the formed product, but such score lines do not increase the rigidity of the final product and, in fact, usually tend to decrease rigidity in shallow pressed products compared to containers which are not scored.

The paperboard plate 10 of the invention is also formed from a unitary flat blank of paperboard stock, either scored or unscored, and thus must also undergo folding in the side wall 12 and rim 13. The resulting fold lines are shown for illustrative purposes at 20 in FIG. 1. However, the plate 10 is produced in such a way that the paperboard in the vicinity of the rim portions of the folds 20 is tightly compressed and essentially bonded together so that the folds 20 in the rim do not present natural hinge lines or lines of weakness and, in fact, have a tensile strength substantially similar to that of the integral paperboard. As described further below, the paperboard material in the rim 13 is densified at the folds, and any voids or disruptions formed in the rim areas of the folds 20 during the pressing operation are compressed out and new bonds are formed between the tightly compacted fibers in these areas. The entire rim is preferably densified and slightly reduced in thickness compared with the bottom of the plate. As shown in the cross-sectional view of FIG. 2, in which the dimensions are exaggerated for purposes of illustration, the thickness of the plate 10 at the flat bottom wall 11 and the upturned side wall 12 is essentially the same as that of the nominal thickness of the unpressed blank from which the plate is made. However, beginning at about the point denoted in 16—the intersection between the side wall portion 12 and the rim portion 13—the paperboard density increases and the thickness of the paperboard decreases out to the rim edge 17. In particular, the entire downwardly extending portion of the rim—the portion of the rim from the top 21 to the edge 17—is thus preferably compressed to a thickness somewhat less than the thickness of the bottom wall. The material of the rim is compensurately denser than the paperboard material in the remainder of the plate, and the areas of the folds 20 are substantially denser than the bottom wall. Generally, the paperboard of the blank preferably has a nominal caliper in the range of 0.010 inch to 0.040 inch with a basis weight in the range of approximately 100 pounds to 400 pounds per 3,000 square feet. The density of the paperboard in the bottom wall and side wall portions is preferably in the range of 10.3 pounds per 0.001 inch caliper per ream (3,000 square feet).

Figure 2:
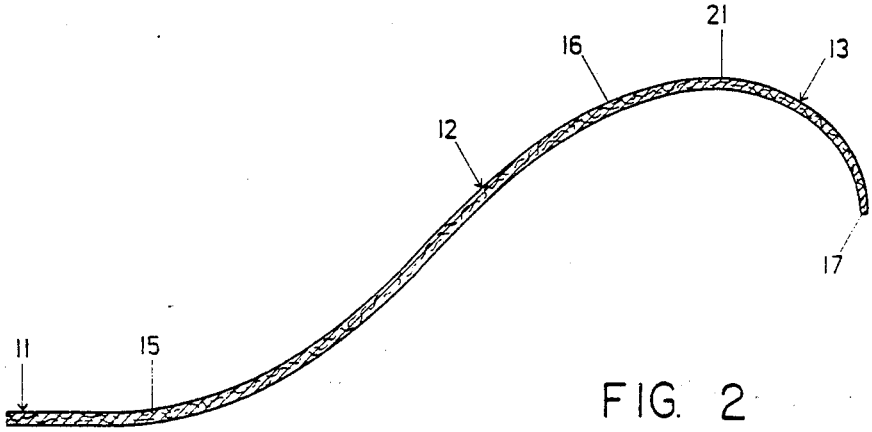
FIG. 2 is a cross-section of the container of FIG. 1 taken generally along the lines 2—2 of FIG. 1.

Containers formed in accordance with the invention have much greater rigidity than comparable containers formed of similar paperboard blank material in accordance with the prior art processes. To provide a comparison of the rigidity of various plates formed in the configuration of the plate 10, a test procedure has been used which measures the force that the plate exerts in resistance to a standard amount of deflection. The test fixture utilized, a Marks II Plate Rigidity Tester, has a wedge shaped support platform on which the plate rests. A pair of plate guide posts are mounted to the support platform at positions approximately equal to the radius of the plate from the apex of the wedge shaped platform. The paper plate is laid on the support platform with its edges abutting the two guide posts so that the platform extends out to the center of the plate. A straight leveling bar, mounted for up and down movement parallel to the support platform, is then moved downwardly until it contacts the top of the rim on either side of the plate so that the plate is lightly held between the platform and the horizontal leveling bar. The probe of a movable force guage, such as a Hunter Force Guage, is then moved into position to just contact the top of the rim under the leveling bar at the unsupported side of the plate. The probe is lowered to deflect the rim downwardly one-half inch, and the force exerted by the deflected plate on the test probe is measured. For typical prior commercially produced 9 inch paper plates similar in shape to the plate 10, rigidity readings made as described above generally averaged about 60 grams or less (using the Hunter Force Guage), whereas the plate 10 as shown in FIGS. 1 and 2, and formed in the manner described below, can be produced with average rigidity readings of at least 90 grams and generally over 100 grams.

Figure 3:
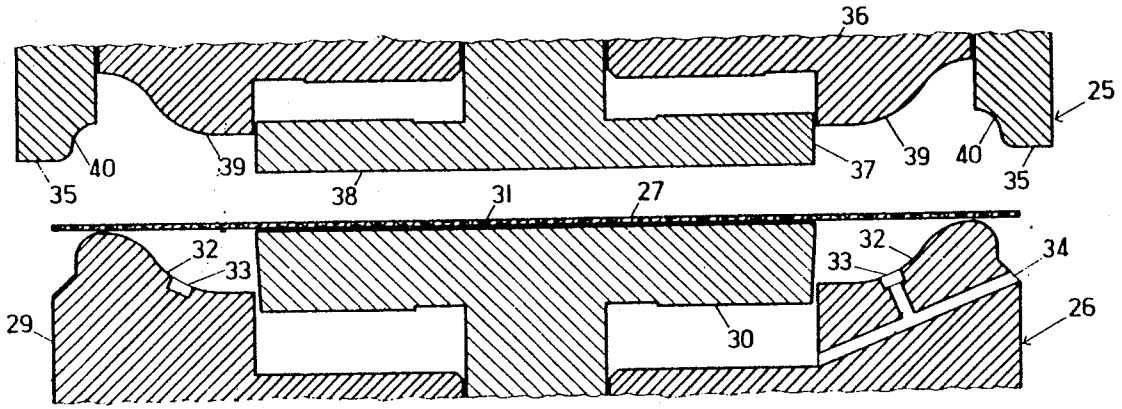
FIG. 3 is a cross-section of the upper and lower dies used to press the container of FIG. 1, showing a flat blank in position between the dies.

FIG. 3 shows a cross-section of the upper die 25 and lower die 26 which are utilized to press a flat, circular paperboard blank 27 into the shape of the plate 10. The construction of the dies 25 and 26, and the equipment on which they are mounted is substantially conventional; for example, as utilized on presses manufactured by the Peerless Manufacturing Company. To facilitate the holding and shaping of the blank 27, the dies are segmented in the manner shown. The lower die 26 has a circular base portion 29 and a central circular platform 30 which is mounted to be movable with respect to the base 29. The platform 30 is cam operated in a conventional manner and urged toward a normal position such that its flat top forming surface 31 is initially above the forming surfaces 32 of the base 29. The platform 30 is mounted for sliding movement to the base 29, with the entire base 29 itself being mounted in a conventional manner on springs (not shown). Because the blank is very tightly pressed at the peripheral rim area, moisture in the paperboard which is driven therefrom during pressing in the heated dies cannot readily escape. To allow the release of this moisture, at least one circular groove 33 is provided in the surface 32 of the base, which vents to the atmosphere through a passageway 34.

Similarly, the top die 25 is segmented into an outer ring portion 35, a base portion 36, and a central platform 37 having a flat forming surface 38. The base portion has curved, symmetrical forming surfaces 39 and the outer ring 35 has curved forming surfaces 40. The central platform 37 and the outer ring 35 are slidingly mounted to the base 39 and biased by springs (not shown) to their normal position shown in FIG. 3 in a commercially conventional manner. The die 25 is mounted to reciprocate toward and away from the lower die 26. In the pressing operation, the blank 27 is first laid upon the flat forming surface 31, generally underlying the bottom wall portion 11 of the plate to be formed, and the forming surface 38 makes first contact with the top of the blank 27 to hold the blank in place as the forming operation begins. Further downward movement of the die 25 brings the spring biased forming surfaces 40 of the outer ring 35 into contact with the edges of the blank 27 to begin to shape the edges of the blank over the underlying surfaces 32 in the areas which will define the overturned rim 13 of the finished plate. However, because the ring 40 is spring biased, the paperboard material in the rim area is not substantially compressed or distorted by the initial shaping since the force applied by the forming surfaces 40 is relatively light and limited to the spring force applied to the die segment 35. Eventually, the die 25 moves sufficiently far down so that the platform segments 30 and 37 and the ring segment 35 are fully compressed such that the adjacent portions of forming surfaces 38 and 39 are coplanar and the adjacent portions of surfaces 39 and 40 are coplanar, and, similarly, that the forming surface 31 is coplanar with the adjacent portion of the forming surfaces 32. The upper die 25 continues to move downwardly and thus drives the entire lower die 26 downwardly against the force of the springs (not shown) which support the die 26. At the full extent of the downward stroke of the upper die 25, the dies exert a force on each other, through the formed blank 27 which separates them, which is equal to the force applied by the compressed springs supporting the die 26. Thus, the amount of force applied to the formed blank 27, and distributed over its area, can be adjusted by changing the length of the stroke of the upper die 25.

In a conventional manner, the dies 25 and 26 are heated with electrical resistance heaters (not shown), and the temperature of the dies is controlled to a selected level by monitoring the temperature of the dies with thermistors (not shown) mounted in the dies as close as possible to the forming surfaces.

In the standard prior paper plate pressing operations, the dies 25 and 26 were machined such that the forming surfaces 38, 39 and 40 of the die 25 were nominally substantially parallel to the forming surfaces 31 and 32 of the lower die 26 at a selected spacing approximately equal to the thickness of the blank being pressed. From a consideration of the geometry of the die surfaces, it can be seen that the upturned sidewall and any downturn on the rim would receive the greatest compressive forces initially if the selected spacing at which the die surfaces are parallel is less than the blank thickness; whereas the top of the rim and the bottom wall would receive substantially all the compressive force if the selected parallel spacing is greater than or equal to the blank thickness. In either case, the force between the dies will be distributed over the entire area of the paperboard between the dies, including the bottom wall which comprises more than half the area of the pressed plate, except where irregularities in the machining of the die surfaces cause high or low spots. As indicated above, plates pressed utilizing uniform die forming surface clearances had relatively low rigidity, primarily due to the severe disruption of the fibers at the wrinkles in the rim of the plate.

Figure 4:
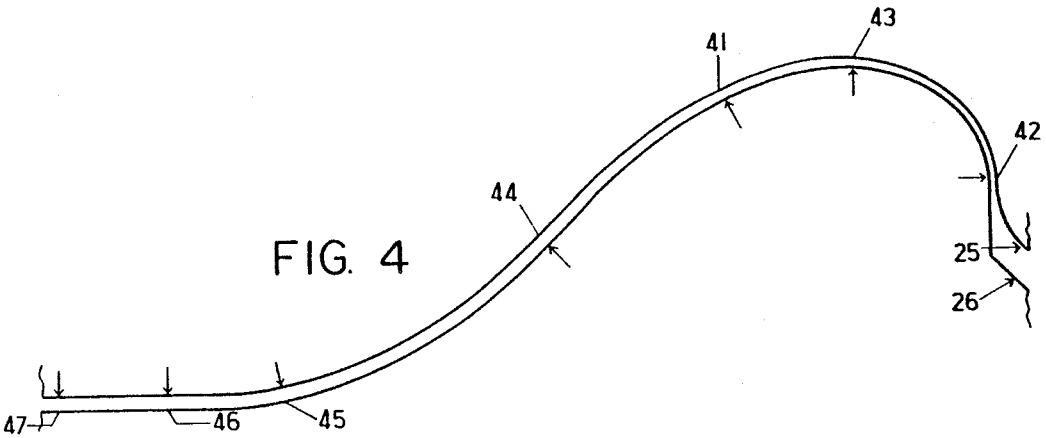
FIG. 4 is a simplified schematic view illustrating the clearances between the upper and lower die surfaces of FIG. 3 when they are adjacent and pressing the paperboard blank between them.

In accordance with the present invention, the forming surfaces 38, 39 and 40 of the upper die 25 are not entirely parallel to the forming surfaces 31 and 32 of the lower die 26 at any spacing. The preferred spacing of the die surfaces in accordance with this invention is shown in the view of FIG. 4, which illustrates a cross-section of the two dies closely adjacent to one another—substantially in the position that they would be in with a paperboard blank between them during the pressing operation. Of course, the relative spacing between the die surfaces will depend upon the thickness of the paperboard blank being formed. However, the topography of the die surfaces can be specified, in general, by assuming that at the circumferential position 41 in the die surfaces at which the side wall of the plate ends and the rim begins, the die surfaces are spaced apart a thickness substantially equal to the nominal thickness of the paperboard blank. The die surfaces are preferably formed such that the spacing between the surfaces decreases gradually and continuously from such reference position toward the rim edge of the paperboard plate formed between the dies. The location in the die surfaces which corresponds to the rim edge is denoted at 42 in FIG. 4, and the location in the die surfaces corresponding to the top of the rim in the formed plate is denoted at 43 in FIG. 4. For paperboard plate stock of conventional thicknesses, i.e., in the range of 0.010 to 0.040 inch, it is preferred that the spacing between the upper die surface and the lower die surface decline continuously from the nominal paperboard thickness at the location 41 to at least 0.002 inch less than the nominal thickness at the location 43 and to at least 0.003 inch less than the nominal thickness at the rim edge location 42. The spacings between the upper and lower dies at other points not on the rim, such as at the mid-point 44 of the side wall area, at the middle 45 of the bend between the bottom wall and the side wall, at the beginning 46 of the side wall, and at the bottom wall 47, are preferably at least as great as the nominal thickness of the paperboard blank. In particular, the spacing between the die surfaces at the bottom wall is substantially greater than the thickness of the paperboard blank so that the bottom wall area receives little pressure. As an example, for a paperboard blank having a nominal thickness of 0.016 inch, satisfactory die surface spacings are: position 42, 0.013 inch; position 43, 0.014 inch; position 41, 0.016 inch; position 44, 0.019 inch; and at positions 46, 47, and 48, at least 0.02 inch. The actual die clearances can be measured by laying strips of solder radially across the surface of the bottom die, pressing the dies together, and measuring the height of the solder at various positions on the die surface after pressing.

It will be apparent from the consideration of the die clearances discussed above that, as the dies 25 and 26 engage the paperboard blank between them, all or substantially all of the force between the two dies will be exerted on the rim area of the pressed blank, which lies generally between the positions labeled 41 and 42 in FIG. 4. The springs upon which the lower die 26 is mounted are typically constructed such that the full stroke of the upper die 25 results in a force applied between the dies of 6,000 to 8,000 pounds. For the common 9 inch diameter (after forming) paper plate, a force between the dies of, e.g., 7,000 pounds, would, if uniformly distributed over the area of the plate, result in a pressure of about 110 pounds per square inch over the entire plate area. However, the die shapes of the invention, as shown in FIG. 4, wherein the rim areas of the die surfaces are spaced more closely together, concentrate most of the force on the plate at the rim. A typical width for the rim—the distance between the lines 41 and 42—for a 9 inch plate would be approximately ½ inch. As an example, if 7,000 pounds of force applied to the dies were concentrated in the rim area, the pressure applied to the paperboard in the rim would be approximately 525 pounds per square inch. Because of the inevitable slight misalignments between the upper and lower dies, high and low spots in the dies, and variations in the paperboard thickness, the pressure applied to the paperboard at some points on the rim will be less than this maximum amount but almost certainly at least 200 pounds per square inch, twice the pressure that would be placed upon the rim if the compressive force were distributed uniformly over the area of the pressed plate, as has nominally been the case in prior paperboard pressing operations.

The compressive forces should be even greater at the folds in the paperboard, since these areas are raised above the rest of the paperboard and contain more fibrous material. There folded areas will comprise a small percentage of the area of the rim, e.g., 4 to 5 percent, so that the compressive force concentrated in these areas may attain many thousands of pounds per square inch. This tremendous pressure serves to greatly densify the fibrous material at the folds in the rim.

The ideal die surface configurations given above would preferably be maintained around the entire circumference of the dies, so that all the die surfaces were perfectly symmetrical. Of course, in the practical machining of the die surfaces, it will be not be possible to maintain perfect symmetry nor will it be possible to achieve, at any radial cross-section through a practical die, the exact, preferred die surface spacings specified above. The most critical tolerances are those within the rim area from the position 41 to the position 42. It is highly preferred that the die clearances in the rim be uniform along any circumferential line around the rim so that all folded areas in the rim receive the intense compressive forces. A satisfactory radial gradient of die surface spacing is, for nominal paperboard thickness "N" at position 41, N −0.002 inch at position 43, and N −0.003 inch at position 42. Satisfactory results have been obtained with dies that have been measured to conform to this gradient within plus or minus 0.002 inch, with best results obtained with dies maintained within 0.001 inch, provided that the spacing between the dies at the positions 45–47 is at least as great as the nominal paperboard thickness N and preferably 0.003 to 0.008 inch greater than the nominal thickness N.

By utilizing the die surface configurations described above, it is possible to apply compressive forces to the rim at a magnitude capable of causing plastic deformation of the rim area of the plate when the other conditions of the process are satisfied, in particular, the moisture content of the blank being formed and the temperatures of the dies. Under the proper process conditions, the fibers in the rim area, particularly at the folds, apparently can break interfiber bonds, compress together under the very high applied stresses, and reform interfiber bonds. The use of these die spacings, with high die forces (e.g. 6,000 to 8,000 pounds), results in compression of the rim area of 15% to 20% or more of the blank thickness, although the fibrous material will tend to spring back toward the unpressed thickness after the pressure is released. Although such high stresses might be expected to cause ripping or localized tearing of the paperboard in the rim area, such does not occur; rather, the plate stock under the rim behaves as if it were a ductile, compressible material. It is found that proper moisture levels within the paperboard are a condition for such ductility or plastic behavior within the paperboard. In addition, the dies are maintained at high, though not excessive temperatures to aid in the pressing process.

The paperboard which is formed into the blanks 27 is conventionally produced by a wet laid papermaking process and is typically available in the form of a continuous web on a roll. The paperboard stock is preferred to have a basis weight in the range of 100 pounds to 400 pounds per ream (3,000 square feet) and a thickness or caliper in the range of about 0.010 inch to 0.040 inch. Lower basis weight and caliper paperboard is preferred for ease of forming and economic reasons. Paperboard stock utilized for forming paper plates is typically formed from bleached pulp furnish, and is usually double clay coated on one side. Such paperboard stock commonly has a moisture (water) content varying from 4.0% to 8.0% by weight.

The effect of the compressive forces at the rim is greatest when proper moisture conditions are maintained within the paperboard: at least 8% and less than 12% water by weight, and preferably 9.5% to 10.5%. Paperboard in this range has sufficient moisture to deform under pressure, but not such excessive moisture that water vapor interferes with the forming operation or that the paperboard is too weak to withstand the high compressive forces applied. To achieve the desired moisture levels within the paperboard stock as it comes off the roll, the paperboard is treated by spraying or rolling on a moistening solution, primarily water, although other components such as lubricants may be added. The moisture content may be monitored with a hand held capacitive-type moisture meter to verify that the desired moisture conditions are being maintained. It is preferred that the plate stock not be formed for a least 6 hours after the moistening operation to allow the moisture within the paperboard to reach equilibrium.

Because of the intended end use of paper plates, the paperboard stock is typically coated on one side with a liquid-proof layer or layers. In addition, for aesthetic purposes, the plate stock is often initially printed before being coated. As an example of a typical coating material, a first layer of polyvinyl acetate emulsion may be applied over the printed paperboard with a second layer of nitrocellulose lacquer applied over the first layer. The plate stock is moistened on the uncoated side after all of the printing and coating steps have been completed.

In the typical forming operation, the web of paperboard stock is fed continuously from a roll through a cutting die (not shown) to form the circular blanks 27, which are then fed into position between the upper and lower dies 25 and 26. The dies are heated, as described above, to aid in the forming process. It has been found that best results are obtained if the upper die 25 and lower die 26—particularly the surfaces thereof—are maintained at a temperature in the range of 250° F. to 320° F. and most preferably 300° F. plus or minus 10° F. These die temperatures have been found to facilitate the plastic deformation of paperboard in the rim areas if the paperboard has the preferred moisture levels. At these preferred die temperatures, the amount of heat applied to the blank is apparently sufficient to liberate the moisture within the blank under the rim and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal production speeds of 40 to 60 pressings a minute, and commensurately higher or lower temperatures in the dies would generally be required for higher or lower production speeds, respectively.

Figure 5:
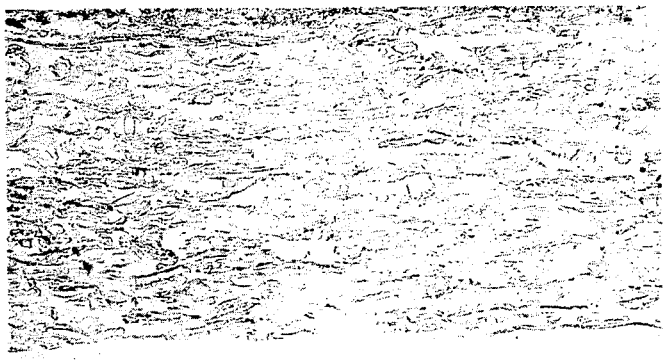
FIG. 5 (Prior Art)
FIG. 5 is a photomicrograph (140×) of a cross-section through the bottom wall portion of a prior commercially produced paperboard plate.
Figure 6:
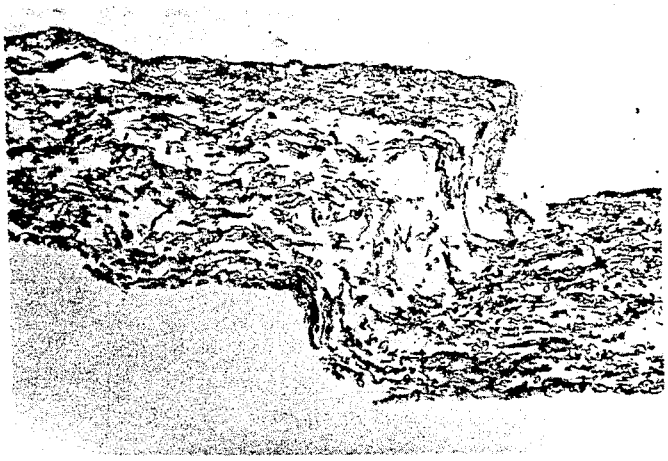
FIG. 6 (Prior Art)
FIG. 6 is a photomicrograph (80×) of a cross-section through the center of the rim portion of a prior commercial paperboard plate.
Figure 7:
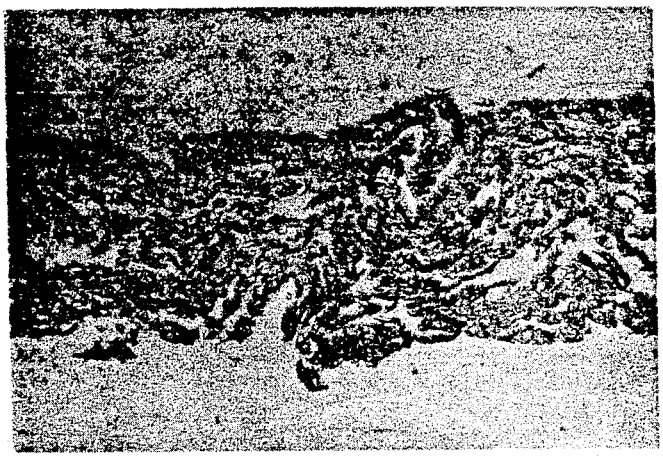
FIG. 7 (Prior Art)
FIG. 7 is a photomicrograph (80×) of a cross-section at a position adjacent the edge of the rim portion of a prior commercial paperboard plate.
Figure 8:
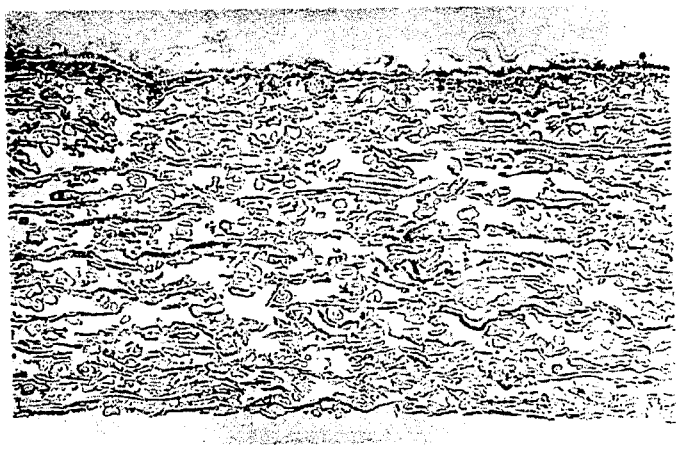
FIG. 8 is a photomicrograph (140×) of a cross-section through the bottom wall portion of a paperboard plate formed in accordance with the invention.
Figure 10:
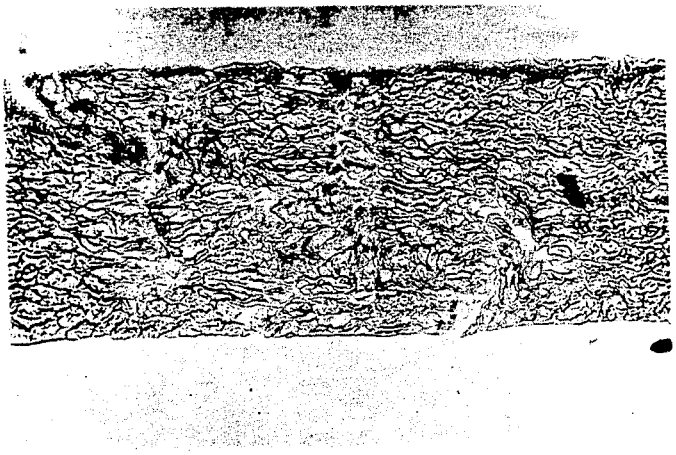
FIG. 10 is a photomicrograph (110×) of a cross-section at a position adjacent the edge of the rim portion of a paperboard plate formed in accordance with the invention.
Figure 9:
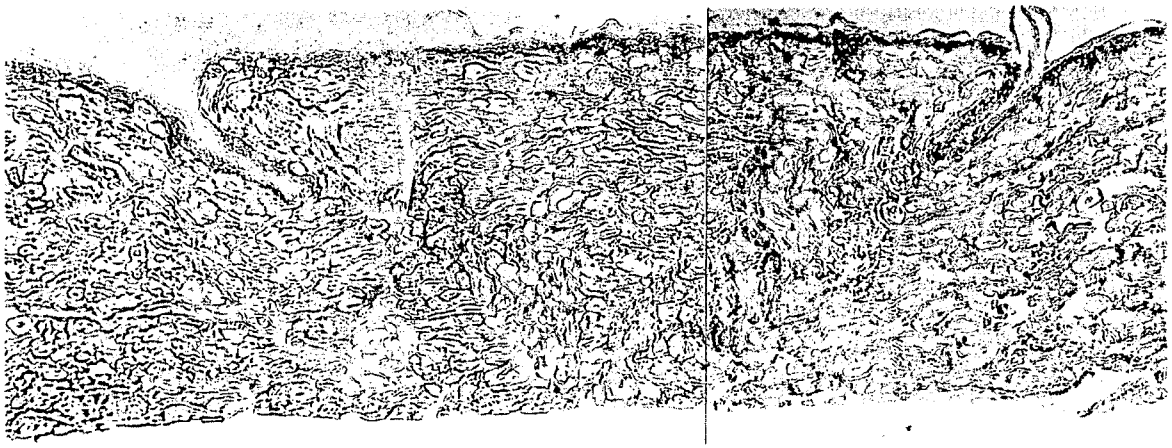
FIG. 9 is a photomicrograph (140×) of a cross-section through the center of the rim portion of a paperboard plate formed in accordance with the invention.

The characteristics of a paper container produced in accordance with the present invention may best be compared with prior paperboard containers formed of similar materials by examining the photomicrographs of FIGS. 5–10. FIGS. 5–7 show various cross-sections through a paperboard plate made in accordance with the prior commercial practice in which the die surfaces are uniformly spaced; whereas FIGS. 8–10 are cross-sections through a paper plate made in accordance with the present invention. Both paper plates were formed of 170 pound per ream (3,000 square feet), 0.016 inch caliper, low density bleached plate stock, clay coated on one side, printed on one surface with standard inks, coated with a first layer of polyvinyl acetate emulsion and overcoated with a nitrocellulose lacquer. The density of the paperboard stock, in basis weight per 0.001 inch of thickness, averages about 10.3, and the Taber Stiffness of the paperboard ranges, with the grain, from about 110 to 300, and across the grain, from about 55 to 165.

The view of FIG. 5 (140×) is through the center portion of the prior plate structure. It may be observed that there are numerous voids within the fiber structure, indicating that the board is not substantially compacted, although the fiber distribution is relatively uniform. The thickness of the cross-section is about 0.016 inch. FIG. 6 (80×) is a cross-sectional view through the rim area of the prior plate, generally cut along a circumferential line at about the top of the rim. The particular view of FIG. 6 is through one of the areas in the rim which has a fold or wrinkle in it. As is graphically apparent from an examination of FIG. 6, the paperboard at the wrinkle has been badly disrupted, leaving large voids between the fibers, with adjacent fibers ripped apart, so that a fault line or very weak area exists within the paperboard at the fold. In addition, it is clear that the surface of the paperboard at the wrinkle is discontinuous, with a large gap existing between adjacent portions. The thickness of the cross-section at the fold is about 0.026 inch and is greater than the original thickness for some distance away from the fold. FIG. 7 (80×) is a cut through the rim, generally along a circumferential line at a position very close to the edge of the rim. This cut shows the termination of the one of the wrinkles running through the rim in the prior plate. Again, in the area of the wrinkle there are wide voids and a rough, discontinuous surface structure. The thickness is about 0.020 inch maximum, at the fold.

The view of FIG. 8 (140×) is a cross-section through the approximate center of a plate made in accordance with the present invention. A comparison of FIG. 8 with FIG. 5 shows that the structure of the paperboard at the center of the pressed plates is substantially similar in both cases; both have relatively even surfaces and substantial voids distributed throughout the matrix of fibers within the board which is characteristic of the unpressed, low density paperboard stock material from which the pressed plates are made. The average thickness is about 0.016 inch. FIG. 9 (140×) is a photomicrograph taken along a cut through the top of the rim portion of a plate made in accordance with the invention, with the cut lying along a circumferential line through one of the folded or wrinkled areas of the pressed plate. The contrast between FIG. 9 and FIG. 6 is significant. The paperboard in the area through which the section of FIG. 9 was taken is highly compacted, leaving very little empty space between the fibers; the structure of this folded region is in marked contrast to the folded regions of FIG. 6 in which there are gapping voids between fiberboard which account for the badly weakened condition of the rim in this area. The paperboard in the rim shown in FIG. 9 has been compacted and its density increased so that the paperboard is clearly denser than at the center region shown in FIG. 8. The maximum thickness of this cross-section, occurring at the two folds above, is about 0.017 inch, substantially the same as the bottom wall. Away from the folded areas, the thickness of the rim is about the same as or somewhat thinner than the bottom wall. Since the folded-over areas contain substantially more solid fibrous material than the rest of the paperboard; perhaps 40 to 100% more, the density of the folded areas is substantially greater than the remainder of the paperboard.

The surfaces of the paperboard of FIG. 9 are essentially smooth and continuous, in contrast again to the discontinuity of surfaces shown in the view of FIG. 6, and the folds within the paperboard of FIG. 9 have been turned back upon themselves and the folded-over surfaces have been squeezed tightly together. The bottom surface, in particular, of the slice shown in FIG. 9 is smooth and continuous, rather than being disrupted at the wrinkle lines as shown in FIG. 6. The coating which covers the top surface of the plate is clearly visible in the view of FIG. 9, and this coating well illustrates where the folds began to occur in the rim of the plate as the plate was being formed. However, the extreme high pressure applied to the rim of the plate has caused virtually all traces of the fold to disappear at the bottom portion of the paperboard where the fibers of the paper have been essentially bonded together, leaving only the vestigial traces of the fold remaining in the top of the paperboard where the coating on the surface prevents the intermingling of fibers. The heat and pressure applied during the forming process may be sufficient to cause some melting and surface adhesion between the abutting coated surfaces which lie along the fold lines, although the nitrocellulose outer coating is resistant to heat and pressure.

A cross-section through a plate of the invention taken just inside of the rim edge is shown in FIG. 10 (110×). Here again, it is seen that the fibers within the plate are substantially compacted, and virtually all evidence of the folds that existed in the rim area during the forming operation has disappeared, except for small areas where the overcoated tops of the folded regions have been laid back upon themselves. The bottom of the paperboard surface is again smooth and unbroken, in sharp contrast to the section through the prior art plate shown in FIG. 7. As well illustrated in FIG. 10, the fibers are tightly and closely compressed together, leaving very few voids or air spaces, and the overall structure is densified so that even though the rim of the plate becomes progressively thinner as the edge is approached, as illustrated in FIG. 2, the basis weight of the paperboard in this region is substantially uniform because of the compaction of the fibers. The thickness of the paperboard shown in FIG. 10 is about 0.0153 inch, about 4 to 5% thinner than the bottom wall. The densification of the plate in the rim area and the laying back of the folded surface areas on themselves to reform the rim into a substantially integral structure results in the marked increases in plate rigidity that have been described above.

Of course, the successful manufacture of pressed containers in accordance with the present process requires attention to the details of the pressing processes in accordance with good manufacturing techniques. In particular, it is necessary to insure that the upper and lower dies 25 and 26 are properly aligned so that they engage the blank between them in the desired manner. Such alignment techniques are a normal part of press maintenance. Observations of plates pressed with the dies can be made to insure that the dies are properly aligned, which is evidenced by a uniformity in the appearance of the downturned edge at the rim of the plate.

It is understood that the invention is not confined to the particular construction and arrangement of parts and the particular processes described herein but embraces such modified forms thereof as come within the scope of the following claims.

What is claimed is:

1. A method of forming a container from a flat blank of fiber substrate, comprising the steps of:

(a) shaping said blank into a formed container having a bottom wall, an upturned sidewall extending from the periphery of the bottom wall and an overturned rim extending from the periphery of the side wall;

(b) during said shaping step, forming a plurality of radially-extending, circumferentially-spaced pleats in said rim, each said pleat including at least three layers of fibrous substrate; and (c) applying heat and pressure to said rim sufficient to decrease the thickness thereof to less than that of said blank and to transform each said pleat into a substantially integrated fibrous structure in which the constituent layers generally lack individual identity, each said structure having a density substantially greater than and a thickness approximately equal to adjacent areas of said rim.

2. The method of claim 1 wherein said shaping step includes forming a downturned lip extending from the periphery of said rim and wherein said pleats radially extend through said lip.

3. The method of claim 1 including the additional step, before the step of shaping the blank, of moistening the blank until it contains between 8% and 12% by weight water.

4. The method of claim 3 wherein the blank is moistened until it contains between 9.5% and 10.5% by weight water.

5. The method of claim 1 wherein the step of applying heat to the rim comprises applying heated surfaces at a temperature between approximately 250° F. and 320° F. to the opposite surfaces of the rim.

6. The method of claim 1 wherein pressure is applied to the rim at a magnitude of at least 200 pounds per square inch.

7. A method of forming a pressed paperboard container comprising the steps of:

(a) providing a flat paperboard blank of 0.010 inch to 0.040 inch thickness, 100 to 400 pounds per ream basis weight, and 8% to 12% water content by weight;

(b) providing cooperating die assemblies having mating die surfaces defining between them a container shape including a bottom wall, an upturned side wall extending from the periphery of the bottom wall and an overturned rim extending from the periphery of the side wall, said die surfaces being so formed that on mating the bottom and side wall portions are spaced a distance approximately equal to the thickness of said blank and the rim portion is spaced less than the thickness of said blank;

(c) heating said die surfaces to a temperature between about 250° F. and 320° F.;

(d) pressing said blank between said die surfaces initially to shape said container and to generate in said rim a plurality of radially-extending, circumferentially-spaced pleats, each pleat including at least three layers of said blank, and subsequently to form said container with sufficient pressure on said rim to decrease the thickness thereof to less than that of said blank and to transform each said pleat into a substantially integrated fibrous structure in which the constituent layers generally lack individual identify, each said structure having a density substantially greater than and a thickness approximately equal to circumferentially adjacent areas of said rim.

8. The method of claim 7 wherein the mated spacing of the rim portion of said die surfaces decreases radially outwardly from the periphery of the side wall portion to the periphery of the rim portion.

9. The method of claim 7 wherein during the step of pressing the blank a force of at least 6,000 pounds is applied between the upper and lower dies.

10. The method of claim 7 wherein the blank has a water content of from 9.5% to 10.5% by weight.

11. The method of claim 7 wherein the step of providing a blank includes the steps of providing a fibrous substrate blank having a water content less than 8% by weight and then moistening the blank until the paperboard of the blank has a water content between 9.5% and 10.5% by weight.

12. The method of claim 7 wherein the step of providing a blank includes providing a blank having a liquid-proof coating on one surface thereof.

13. The method of claim 7 wherein the paperboard provided has a thickness of about 0.016 inch and a basis weight of about 170 pounds per 3,000 square feet.

* * * * *

UNITED STATES PATENT AND TRADEMARK OFFICE

CERTIFICATE OF CORRECTION

PATENT NO. : 4,721,500

DATED : January 26, 1988

INVENTOR(S) : Gerald J. Van Handel, et la

It is certified that error appears in the above-indentified patent and that said Letters Patent is hereby corrected as shown below:

Column 1, line 6, after "4,609,140" insert -- , which is a continuation of application Serial No. 619,402, filed June 12, 1984, abandoned, which is a continuation of application Serial No. 367,880, filed April 13, 1982, abandoned --.

Signed and Sealed this

Thirty-first Day of January, 1995

*Attest:*

Bruce Lehman

BRUCE LEHMAN

*Attesting Officer*

*Commissioner of Patents and Trademarks*